US007614266B2

(12) United States Patent
White et al.

(10) Patent No.: US 7,614,266 B2
(45) Date of Patent: Nov. 10, 2009

(54) SECURITY APPARATUS WITH RESET MECHANISM

(75) Inventors: Ryan White, San Francisco, CA (US); John Hung, British Columbia (CA)

(73) Assignee: ACCO Brands USA LLC, Lincolnshire, IL (US)

( * ) Notice: Subject to any disclaimer, the term of this patent is extended or adjusted under 35 U.S.C. 154(b) by 73 days.

(21) Appl. No.: 11/872,394

(22) Filed: Oct. 15, 2007

(65) Prior Publication Data

US 2009/0095034 A1 Apr. 16, 2009

(51) Int. Cl.
*E05B 69/00* (2006.01)

(52) U.S. Cl. ..... 70/58; 70/14; 70/312; 70/314

(58) Field of Classification Search ..... 70/14, 70/18, 58, 312, 314
See application file for complete search history.

(56) References Cited

U.S. PATENT DOCUMENTS

| | | | |
|---|---|---|---|
| 87,045 | A | 2/1869 | Holmes |
| 285,074 | A | 9/1883 | Rhoades et al. |
| 505,299 | A | 9/1893 | Schneider |
| 606,734 | A | 7/1898 | Olmstead |
| 611,646 | A | 10/1898 | Parker |
| 786,842 | A | 4/1905 | Robeson |
| 881,364 | A | 3/1908 | Wheeler |
| 934,928 | A | 9/1909 | Michel |
| 942,537 | A | 12/1909 | Batdorf |
| 952,411 | A | 3/1910 | Billy |
| 1,004,333 | A | 9/1911 | Alsterberg |
| 1,050,276 | A | 1/1913 | Johnson |
| 1,101,450 | A | 6/1914 | Kerry |
| 1,432,546 | A | 10/1922 | Gillom |
| 1,452,471 | A | 4/1923 | Kline |
| 1,470,937 | A | 10/1923 | Schou |
| 1,534,936 | A | 4/1925 | Fishchbach |
| 1,672,333 | A | 6/1928 | Miller |
| 1,786,511 | A | 12/1930 | Warren |
| 1,978,935 | A | 10/1934 | Douglas |
| 2,001,354 | A | 5/1935 | Smith |
| 2,102,583 | A | 12/1937 | Alberg |
| 2,109,109 | A | 2/1938 | Finch |

(Continued)

FOREIGN PATENT DOCUMENTS

CA 454901 3/1949

(Continued)

OTHER PUBLICATIONS

U.S. Appl. No. 90/007,221, Murray Jr. et al.

(Continued)

*Primary Examiner*—Suzanne D Barrett
(74) *Attorney, Agent, or Firm*—Townsend and Townsend and Crew LLP

(57) ABSTRACT

A security apparatus, a security system that uses the security apparatus, and a method of using the securing apparatus to secure a portable electronic device to an immovable object. The security apparatus comprises a combination locking mechanism with dials and tumblers, a body coupled to the dials, a reset device coupled to the tumblers, and a reset key configured to interact with the reset device to allow the user to reset the combination associated with the combination locking mechanism.

15 Claims, 6 Drawing Sheets

U.S. PATENT DOCUMENTS

| | | | | | |
|---|---|---|---|---|---|
| 2,130,216 | A | | 9/1938 | Zaninovich | |
| 2,172,208 | A | | 9/1939 | Kutrzon | |
| 2,190,661 | A | | 2/1940 | Hauer | |
| 2,383,397 | A | | 8/1945 | Lofquist | |
| 2,405,400 | A | | 8/1946 | Butterfiled | |
| 2,435,876 | A | | 2/1948 | De Swart | |
| 2,469,874 | A | | 5/1949 | Fetsko, Jr. | |
| 2,480,662 | A | | 8/1949 | McKinzie | |
| 2,530,560 | A | | 11/1950 | Young | |
| 2,577,956 | A | | 12/1951 | Elsberg | |
| 2,594,012 | A | | 4/1952 | Griffin | |
| 2,660,084 | A | | 11/1953 | Newman | |
| 2,677,261 | A | | 5/1954 | Jacobi | |
| 2,729,418 | A | | 1/1956 | Maynard | |
| 2,800,090 | A | | 7/1957 | Reid | |
| 2,963,310 | A | | 12/1960 | Abolins | |
| 3,091,011 | A | | 5/1963 | Campbell | |
| 3,101,695 | A | | 8/1963 | Honeyman, Jr. | |
| 3,130,571 | A | | 4/1964 | Neumann | |
| 3,136,017 | A | | 6/1964 | Preziosi | |
| 3,171,182 | A | | 3/1965 | Danehy | |
| 3,174,384 | A | | 3/1965 | Vanni | |
| 3,200,694 | A | | 8/1965 | Rapata | |
| 3,211,408 | A | | 10/1965 | Schaefer | |
| 3,213,745 | A | | 10/1965 | Dwyer | |
| 3,220,077 | A | | 11/1965 | Newcomer, Jr. et al. | |
| 3,276,835 | A | | 10/1966 | Hall | |
| 3,469,874 | A | | 9/1969 | Mercurio | |
| 3,486,158 | A | | 12/1969 | Soltysik et al. | |
| 3,521,845 | A | | 7/1970 | Sweda et al. | |
| 3,590,608 | A | | 7/1971 | Smyth et al. | |
| 3,596,285 | A | | 7/1971 | Garland | |
| 3,625,031 | A | | 12/1971 | Alley III | |
| 3,634,963 | A | | 1/1972 | Hermann | |
| 3,664,163 | A | | 5/1972 | Foote | |
| 3,722,239 | A | | 3/1973 | Mestre | |
| 3,727,934 | A | | 4/1973 | Averbook et al. | |
| 3,737,135 | A | | 6/1973 | Bertolini | |
| 3,754,420 | A | | 8/1973 | Oellerich | |
| 3,765,197 | A | | 10/1973 | Foote | |
| 3,766,760 | A | * | 10/1973 | Mohrhauser et al. | 70/314 |
| 3,771,338 | A | | 11/1973 | Raskin | |
| 3,772,645 | A | | 11/1973 | Odenz et al. | |
| 3,782,146 | A | | 1/1974 | Franke | |
| 3,785,183 | A | | 1/1974 | Sander | |
| 3,798,934 | A | | 3/1974 | Wright et al. | |
| 3,826,510 | A | | 7/1974 | Halter | |
| D232,416 | S | | 8/1974 | Gazda et al. | |
| 3,836,704 | A | | 9/1974 | Coules | |
| 3,859,826 | A | | 1/1975 | Singer et al. | |
| 3,866,873 | A | | 2/1975 | Bohli | |
| 3,875,645 | A | | 4/1975 | Tucker et al. | |
| 3,898,641 | A | | 8/1975 | Banner | |
| 3,905,570 | A | | 9/1975 | Nieuwveld | |
| 3,910,079 | A | | 10/1975 | Gassaway | |
| 3,910,081 | A | | 10/1975 | Pender | |
| 3,939,752 | A | | 2/1976 | Koscik | |
| 3,986,780 | A | | 10/1976 | Nivet | |
| 3,990,276 | A | | 11/1976 | Shontz | |
| 3,999,410 | A | | 12/1976 | Hall | |
| 4,003,228 | A | | 1/1977 | Lievens et al. | |
| 4,004,440 | A | | 1/1977 | Dreyer | |
| 4,007,613 | A | | 2/1977 | Gassaway | |
| 4,018,339 | A | | 4/1977 | Pritz | |
| 4,028,913 | A | | 6/1977 | Falk | |
| 4,028,916 | A | | 6/1977 | Pender | |
| 4,047,748 | A | | 9/1977 | Whaley et al. | |
| 4,055,973 | A | | 11/1977 | Best | |
| 4,057,984 | A | | 11/1977 | Avaiusini | |
| 4,065,083 | A | | 12/1977 | Gassaway | |
| 4,066,195 | A | | 1/1978 | Dickler | |
| 4,066,231 | A | | 1/1978 | Bahner | |
| 4,104,951 | A | | 8/1978 | Leitner | |
| 4,114,409 | A | | 9/1978 | Scire | |
| 4,118,902 | A | | 10/1978 | Saxton | |
| 4,123,922 | A | | 11/1978 | Kuenstler | |
| 4,131,001 | A | | 12/1978 | Gotto | |
| 4,212,175 | A | | 7/1980 | Zakow | |
| 4,223,542 | A | | 9/1980 | Basseches | |
| 4,252,007 | A | | 2/1981 | Kerley | |
| 4,263,833 | A | | 4/1981 | Loudin | |
| 4,300,371 | A | | 11/1981 | Herwick et al. | |
| 4,311,883 | A | | 1/1982 | Kidney | |
| 4,337,462 | A | | 6/1982 | Lemelson | |
| 4,383,425 | A | * | 5/1983 | Orabona | 70/312 |
| 4,391,110 | A | | 7/1983 | Nielson | |
| 4,394,101 | A | | 7/1983 | Richer | |
| 4,418,550 | A | | 12/1983 | Hamilton | |
| 4,419,034 | A | | 12/1983 | DiMartino | |
| 4,442,571 | A | | 4/1984 | Davis et al. | |
| 4,448,049 | A | | 5/1984 | Murray | |
| 4,462,233 | A | | 7/1984 | Horetzke | |
| 4,466,259 | A | | 8/1984 | Osgood | |
| 4,471,980 | A | | 9/1984 | Hickman | |
| 4,478,545 | A | | 10/1984 | Mizusawa | |
| 4,501,460 | A | | 2/1985 | Sisler | |
| 4,502,305 | A | | 3/1985 | Bakker | |
| 4,520,641 | A | * | 6/1985 | Bako | 70/312 |
| 4,527,405 | A | | 7/1985 | Renick et al. | |
| 4,570,465 | A | | 2/1986 | Bennett | |
| 4,579,492 | A | | 4/1986 | Kazino | |
| 4,584,856 | A | | 4/1986 | Petersdorff et al. | |
| 4,586,843 | A | | 5/1986 | Henge et al. | |
| 4,593,273 | A | | 6/1986 | Narcisse | |
| 4,598,272 | A | | 7/1986 | Cox | |
| 4,603,829 | A | | 8/1986 | Koike et al. | |
| 4,610,152 | A | * | 9/1986 | Duringer | 70/30 |
| 4,610,587 | A | | 9/1986 | Wollar | |
| 4,616,490 | A | | 10/1986 | Robbins | |
| 4,620,182 | A | | 10/1986 | Keifer | |
| 4,640,106 | A | | 2/1987 | Derman | |
| 4,651,544 | A | | 3/1987 | Hungerford | |
| 4,654,640 | A | | 3/1987 | Carll et al. | |
| 4,655,057 | A | | 4/1987 | Derman | |
| 4,656,848 | A | | 4/1987 | Rose | |
| 4,667,491 | A | | 5/1987 | Lokken et al. | |
| 4,676,080 | A | | 6/1987 | Schwarz | |
| 4,680,949 | A | | 7/1987 | Stewart | |
| 4,685,312 | A | | 8/1987 | Lakoski et al. | |
| 4,691,891 | A | | 9/1987 | Dionne | |
| 4,692,968 | A | | 9/1987 | Girard | |
| 4,704,881 | A | | 11/1987 | Sloop, Sr. | |
| 4,722,208 | A | * | 2/1988 | Ye | 70/312 |
| 4,733,840 | A | | 3/1988 | D'Amore | |
| 4,735,067 | A | * | 4/1988 | Tawil | 70/312 |
| 4,738,428 | A | | 4/1988 | Themistos et al. | |
| 4,741,185 | A | | 5/1988 | Weinert et al. | |
| 4,768,361 | A | | 9/1988 | Derman | |
| 4,770,583 | A | | 9/1988 | Lindberg | |
| 4,779,434 | A | | 10/1988 | Derman | |
| 4,785,291 | A | | 11/1988 | Hawthorne | |
| 4,801,232 | A | | 1/1989 | Hempel | |
| 4,804,943 | A | | 2/1989 | Soleimani | |
| 4,805,426 | A | | 2/1989 | Dimmick et al. | |
| 4,813,252 | A | | 3/1989 | Ray | |
| 4,826,193 | A | | 5/1989 | Davis | |
| 4,831,860 | A | * | 5/1989 | Sheiman et al. | 70/312 |
| 4,834,600 | A | | 5/1989 | Lemke | |
| 4,842,912 | A | | 6/1989 | Hutter, III | |
| 4,843,848 | A | | 7/1989 | Igelmund | |
| 4,856,304 | A | | 8/1989 | Derman | |
| 4,856,305 | A | | 8/1989 | Adams | |
| 4,858,455 | A | | 8/1989 | Kuo | |
| 4,860,561 | A | * | 8/1989 | Hwang | 70/28 |

4,862,716 A 9/1989 Derman
4,869,082 A 9/1989 Appelbaum
4,870,840 A 10/1989 Klein
4,878,045 A 10/1989 Tanaka et al.
4,893,488 A 1/1990 Klein
4,896,140 A 1/1990 Biever
4,907,111 A 3/1990 Derman
4,907,716 A 3/1990 Wankel et al.
4,918,952 A 4/1990 Lakoski et al.
4,924,683 A 5/1990 Derman
4,924,693 A 5/1990 College
4,938,040 A 7/1990 Humphreys, Jr.
4,959,635 A 9/1990 Wilson
4,959,979 A 10/1990 Filipow et al.
4,964,285 A 10/1990 Lakoski
4,966,511 A 10/1990 Lee
4,969,342 A 11/1990 Marchiori
4,978,265 A 12/1990 DeWan
4,979,382 A 12/1990 Perry
4,985,695 A 1/1991 Wilkinson et al.
4,986,097 A 1/1991 Derman
4,993,244 A 2/1991 Osman
5,001,460 A 3/1991 Basson
5,001,854 A 3/1991 Derman
5,010,748 A 4/1991 Derman
5,022,242 A 6/1991 Povilaitis
5,024,072 A 6/1991 Lee
5,027,627 A 7/1991 Derman
5,050,836 A 9/1991 Makous
5,052,199 A 10/1991 Derman
5,063,763 A 11/1991 Johnson
5,066,942 A 11/1991 Matsuo
5,067,151 A 11/1991 Inagaki
5,076,079 A 12/1991 Monoson
5,082,232 A 1/1992 Wilson
5,082,233 A 1/1992 Ayers et al.
5,099,663 A 3/1992 Dearstine
5,117,661 A 6/1992 Carl et al.
5,119,649 A 6/1992 Spence
5,135,197 A 8/1992 Kelley et al.
5,138,785 A 8/1992 Paterson
5,146,769 A 9/1992 Smith
5,154,456 A 10/1992 Moore
5,169,326 A * 12/1992 Werner ..... 439/134
5,184,798 A 2/1993 Wilson
5,197,706 A 3/1993 Braithwaite et al.
5,223,815 A 6/1993 Rosenthal et al.
D337,040 S 7/1993 Carl
5,228,319 A 7/1993 Holley et al.
5,235,831 A * 8/1993 Lauria et al. ..... 70/312
5,279,136 A 1/1994 Perry
5,317,304 A 5/1994 Choi
5,327,752 A 7/1994 Myers et al.
D350,473 S 9/1994 Simon
5,349,834 A 9/1994 Davidge
5,351,507 A 10/1994 Derman
5,351,508 A 10/1994 Kelley
5,361,610 A 11/1994 Sanders
5,370,488 A 12/1994 Sykes
5,377,512 A 1/1995 Kelley
5,381,685 A 1/1995 Carl et al.
5,390,514 A 2/1995 Harmon
5,390,977 A 2/1995 Miller
5,394,713 A 3/1995 Harmon
5,397,171 A 3/1995 Leach
5,398,530 A 3/1995 Derman
5,400,622 A 3/1995 Harmon
5,406,809 A 4/1995 Igelmund
5,412,959 A 5/1995 Bentley
5,421,667 A 6/1995 Leyden et al.
5,447,049 A 9/1995 Shien
5,466,022 A 11/1995 Derman
5,473,917 A 12/1995 Say
5,489,173 A 2/1996 Hofle
5,493,878 A 2/1996 Murray et al.
5,502,989 A 4/1996 Murray et al.
5,520,031 A 5/1996 Davidge
D370,473 S 6/1996 Derman
5,548,981 A 8/1996 Kirk
5,570,080 A 10/1996 Inoue et al.
5,579,657 A 12/1996 Makous
5,593,878 A 1/1997 Knopf et al.
5,603,416 A 2/1997 Richardson et al.
5,608,605 A 3/1997 Siow et al.
5,610,587 A 3/1997 Fujiuchi et al.
5,611,223 A 3/1997 Spitzer
5,622,064 A 4/1997 Gluskoter et al.
5,636,539 A * 6/1997 Tsai ..... 70/315
5,653,136 A * 8/1997 Huang ..... 70/312
5,661,991 A * 9/1997 Hsu ..... 70/312
5,687,592 A 11/1997 Penniman
5,692,400 A 12/1997 Bliven et al.
5,709,110 A 1/1998 Greenfield et al.
D390,761 S 2/1998 Choi
5,787,739 A 8/1998 Derman
5,791,171 A 8/1998 Kelley
5,794,463 A 8/1998 McDaid
5,799,520 A 9/1998 Laabs et al.
5,836,183 A 11/1998 Derman
5,870,281 A 2/1999 Kim
5,875,657 A 3/1999 Kelley
5,889,463 A 3/1999 Judd et al.
6,389,653 B1 5/1999 Pate et al.
5,913,907 A 6/1999 Lee
5,924,313 A * 7/1999 Kuo ..... 70/26
5,934,120 A * 8/1999 Kuo ..... 70/312
5,960,651 A 10/1999 Tanisawa
5,963,131 A 10/1999 D'Angelo et al.
5,983,679 A 11/1999 Reyes
6,000,251 A 12/1999 Murray et al.
6,000,252 A 12/1999 Murray et al.
6,006,557 A 12/1999 Carl et al.
6,038,891 A 3/2000 Zeren et al.
6,058,744 A 5/2000 Ling
6,081,974 A 7/2000 McDaid
6,087,939 A 7/2000 Leyden et al.
6,112,561 A 9/2000 Carl
6,112,562 A 9/2000 Murray, Jr. et al.
6,125,669 A 10/2000 McDaid et al.
6,133,830 A 10/2000 D'Angelo et al.
6,150,940 A 11/2000 Chappman et al.
6,155,088 A 12/2000 Murray, Jr. et al.
6,170,364 B1 1/2001 Johnson
6,173,591 B1 1/2001 Derman
6,199,413 B1 3/2001 McDaid et al.
6,205,824 B1 3/2001 Miao
6,212,918 B1 4/2001 Kravtin
6,227,017 B1 5/2001 Ingelmund
6,244,080 B1 6/2001 Sakurai
6,244,082 B1 6/2001 Avganim
6,257,029 B1 7/2001 Liao
6,262,664 B1 7/2001 Maloney
6,265,974 B1 7/2001 D'Angelo et al.
6,300,874 B1 10/2001 Rand
6,301,940 B1 10/2001 Derman et al.
6,317,936 B1 11/2001 McDaid et al.
6,360,405 B1 3/2002 McDaid et al.
6,386,005 B1 * 5/2002 Kuo ..... 70/28
6,389,854 B1 5/2002 Huang
6,401,502 B1 6/2002 Yang
6,427,499 B1 8/2002 Derman
6,449,992 B1 8/2002 Yu
6,513,350 B1 2/2003 Hurd et al.
6,553,794 B1 4/2003 Murray, Jr. et al.
6,588,241 B1 7/2003 Murray, Jr. et al.
6,591,642 B1 7/2003 Kuo

| | | | | |
|---|---|---|---|---|
| 6,598,433 | B1 | 7/2003 | Malvasio | |
| 6,619,080 | B1 | 9/2003 | Yu | |
| 6,619,081 | B1 | 9/2003 | Yu | |
| 6,621,415 | B1 | 9/2003 | Willis | |
| 6,735,990 | B1 | 5/2004 | Murray, Jr. et al. | |
| 6,758,069 | B2 | 7/2004 | Derman | |
| 6,763,688 | B1 | 7/2004 | Syu | |
| 6,763,690 | B2 | 7/2004 | Galant | |
| 6,845,643 | B2 * | 1/2005 | Tsai | 70/312 |
| 6,886,376 | B2 | 5/2005 | Kuo | |
| 6,933,847 | B2 | 8/2005 | Feibelman | |
| 6,973,809 | B2 | 12/2005 | Chang | |
| 7,028,513 | B2 | 4/2006 | Avganim | |
| 7,121,125 | B2 | 10/2006 | Murray et al. | |
| 7,143,614 | B1 | 12/2006 | Murray et al. | |
| 2002/0104337 | A1 * | 8/2002 | Kuo | 70/30 |
| 2002/0134119 | A1 | 9/2002 | Derman | |
| 2003/0101778 | A1 | 6/2003 | Carl et al. | |
| 2004/0040350 | A1 | 3/2004 | Derman | |
| 2004/0079122 | A1 * | 4/2004 | Tsai | 70/30 |
| 2004/0206138 | A1 | 10/2004 | Murray et al. | |
| 2005/0150262 | A1 | 7/2005 | Murray et al. | |
| 2005/0150263 | A1 | 7/2005 | Murray et al. | |
| 2005/0178173 | A1 | 8/2005 | Kuo | |

FOREIGN PATENT DOCUMENTS

| | | | |
|---|---|---|---|
| CA | 791364 | | 8/1968 |
| CA | 987121 | | 4/1976 |
| DE | 329934 | | 12/1920 |
| DE | 335741 | | 4/1921 |
| DE | 361068 | | 4/1923 |
| DE | 456219 | | 2/1928 |
| DE | 577757 | | 8/1932 |
| DE | 3202700 | | 8/1983 |
| DE | 3407723 | A1 | 5/1985 |
| DE | 3824393 | | 7/1989 |
| FR | 455740 | | 8/1913 |
| FR | 877220 | | 12/1942 |
| FR | 1026519 | | 4/1953 |
| FR | 1085107 | | 1/1955 |
| FR | 2308006 | | 11/1976 |
| FR | 2636686 | A1 | 3/1990 |
| GB | 447091 | | 5/1936 |
| GB | 1256295 | | 12/1971 |
| GB | 1376011 | | 12/1974 |
| GB | 2109109 | A | 5/1983 |
| GB | 2234856 | A | 2/1991 |
| HU | P0000398 | | 6/2000 |
| HU | 224329 | | 6/2003 |
| IT | 451949 | | 10/1949 |
| JP | 49-91096 | | 8/1974 |
| JP | 52-36813 | | 3/1977 |
| JP | 57-25092 | | 2/1982 |
| JP | 57-179618 | | 11/1982 |
| JP | 2000-140948 | | 5/2005 |
| JP | 37-7592 | | 10/2005 |
| NO | 14095 | | 5/1905 |
| WO | WO 86/00396 | | 1/1986 |
| WO | WO 93/15295 | | 8/1993 |
| WO | WO 95/10680 | | 4/1995 |
| WO | WO 96/07002 | A1 | 3/1996 |

OTHER PUBLICATIONS

U.S. Appl. No. 90/007,225, Carl et al.
U.S. Appl. No. 90/007,674, Myers et al.
U.S. Appl. No. 95/000,116, Murray Jr. et al.
U.S. Appl. No. 09/804,973, Murray et al.
U.S. Appl. No. 10/970,060, Merrem et al.
U.S. Appl. No. 11/000,397, Merrem et al.
Kablit Security System Catalog, pp. 7, 93, 1988. Computer and Office Equipment Security Catalog, 1990, Secure-It, Inc., 18 Maple Court, East Longmeadow, MA 01028.
Kensington Product Brochure for Kensington Apple Laser Writer and Macintosh Portable Security Systems, Computer and Office Equipment Security Catalog, 1990, Secure-It, Inc., 18 Maple Court, East Longmeadow, MA 01028.
Apple Security Bracket sold in AS kit.
Retaining Device Incorporated in Apple Computers.
Kensington MicroSaver Computer Lock Box and Literature. 3 pages.
Kensington Product News Release; "Kensington Wins Case Protecting Cable Lock Status", 2003, 1 page.
*ACCO Brands, Inc.* v. *Micro Security Devices, Inc.* Federal Circuit Court Order Granting Defendant's Motion for Summary Judgment, Jul. 23, 2002, 13 pages.
Maltoni, D. et al.; "Handbook of Fingerprint Recognition"; Chapter 1: Introduction, 2003, Springer, New York, pp. 1-52.
Passproof User Manual 1990, 5 pages.
Flexguard Security System, Philadelphia Security Products (no date on page) (1 page).
Los Angeles Times, Jan. 12, 1989, Part V, p. 10.
Kensington Microsaver Packaging and Manual (copyright 1992), 4 pages.
Targus DEFCON 1 Ultra Notebook Computer Security System, User's Guide, copyright 2001.
Targus DEFCON 1 Ultra Notebook Computer Security System; http://www.targus.com/us/product_details.asp?sku=PA400U.

* cited by examiner

SECURITY APPARATUS WITH RESET MECHANISM

BACKGROUND OF THE INVENTION

A variety of systems have been developed to inhibit the theft of laptop computers and other portable electronic devices such as monitors, printers, and projectors. Such systems often employ security apparatuses which attach the devices to an immovable object or an object that is difficult to move such as a desk.

These security apparatuses sometimes use combination locks that can be reset to a new combination by a user. As used herein, resetting a combination refers to changing the existing combination. To reset the combination lock, the user typically activates a reset mechanism that is attached to the combination lock. For example, the user may flip a lever on a combination lock to disengage the tumblers from the dials of the combination lock to reset the combination. The principal difficulty with these types of combination locks is that lever or other reset mechanism can be accidentally activated and the combination unintentionally reset.

Embodiments of the invention address this and other problems, individually and collectively.

BRIEF SUMMARY OF THE INVENTION

Embodiments of the invention relate to security apparatuses, methods for using such security apparatuses, and systems including such security apparatuses.

One embodiment of the invention is directed to a security apparatus for use with a portable electronic device having a first aperture. The security apparatus comprises a combination locking mechanism having a plurality of tumblers and a plurality of dials corresponding to the plurality of tumblers, a body coupled to the plurality of dials, a reset device coupled to the plurality of tumblers, and a reset key configured to interact with the reset device to allow a user to change a combination associated with the combination locking mechanism.

Another embodiment of the invention is directed to a method of using a security apparatus with a portable electronic device having a first aperture, the security apparatus having a combination locking mechanism with a plurality of tumblers and a plurality of dials associated with the plurality of tumblers. The method includes interfacing the reset key with the reset device and resetting the combination associated with the combination locking mechanism using the reset key.

Another embodiment of the invention is directed to a security system that includes an immovable object, a portable electronic device having a first aperture, and a security apparatus coupled to the immovable object. The security apparatus includes a combination locking mechanism having a plurality of tumblers and a plurality of dials corresponding to the plurality of tumblers, a body coupled to the plurality of dials, a reset device coupled to the plurality of tumblers, and a reset key configured to interact with the reset device to allow a user to change a combination associated with the combination locking mechanism.

These and other embodiments of the invention are described in further detail below.

DETAILED DESCRIPTION

Figure 1:
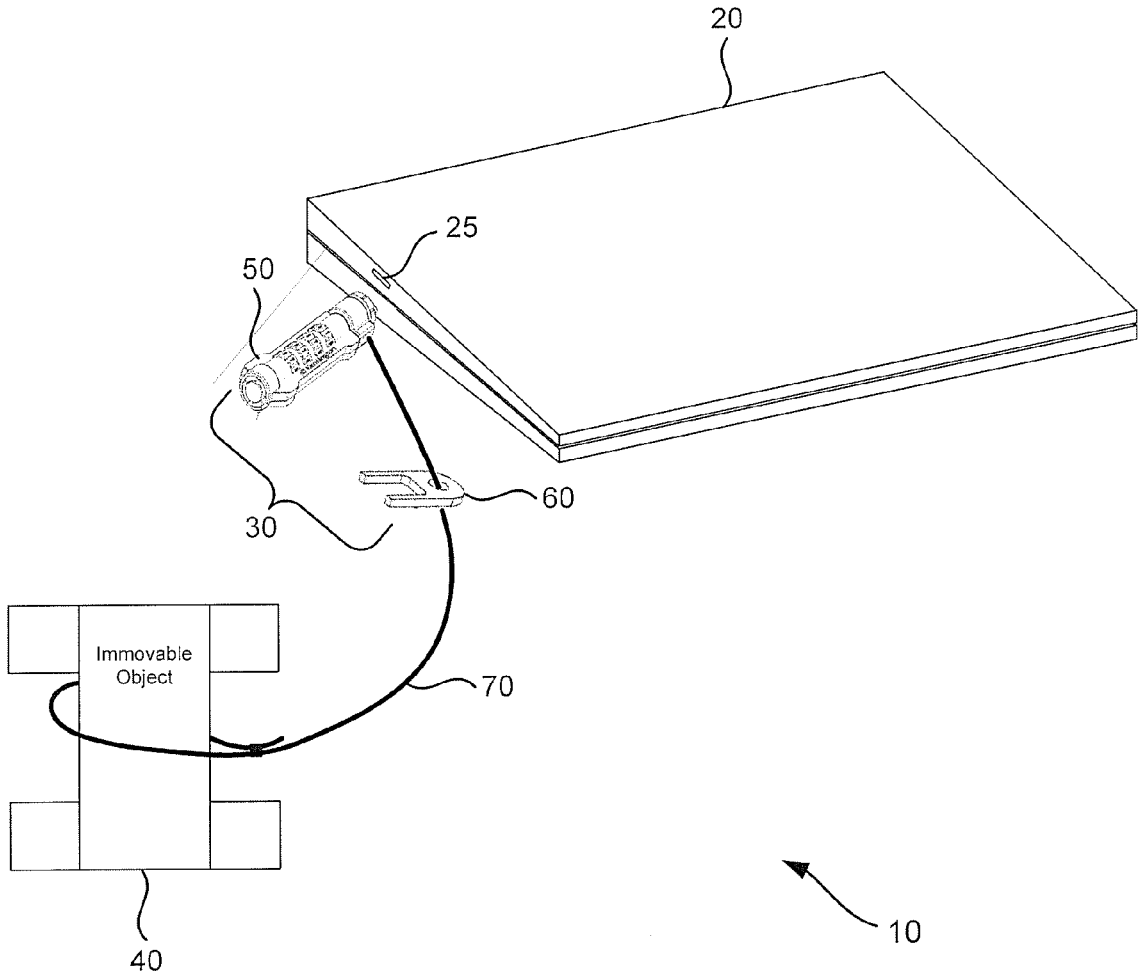
FIG. 1 shows a layout of a security system comprising a portable electronic device with an aperture and a security apparatus that is used to secure portable electronic device to an immovable object, according to one embodiment of the invention.

Embodiments of the invention are directed to a security apparatus with a reset mechanism, a method for using the security apparatus with the reset mechanism, and a system of using the security apparatus with the reset mechanism. More specifically, the security apparatus has a combination locking mechanism and a reset key that allows the user to change (i.e., reset) the combination associated with the combination locking mechanism. When locked, the security apparatus with the reset mechanism can be used to prevent or deter the theft of portable electronic devices.

To operate one embodiment of the security apparatus, the user unlocks the security apparatus by turning the dials to the current combination to align the tumblers. The user inserts a securing member into an aperture of the portable electronic device. The user pushes a push button device on the security apparatus causing a slider to move along the securing member into the aperture. The user releases the push button device to secure the securing member and slider within the aperture.

When unlocked, the user can also reset the combination associated with the security apparatus by using the reset key. The user inserts the reset key into the main portion of the security apparatus until it contacts the reset device. The user continues to push the reset key to move the reset device, which in turn moves forward to move the tumblers forward relative to the dials until the tumblers disengage from the dials in a reset position. The dials can now spin free of the tumblers so that the user can select a new combination. The user rotates the reset key to secure the reset device to the body and keep the reset device in the reset position without the user needing to hold it while the combination is being reset. The user selects a new combination by turning the disengaged dials. After the new combination is selected, the user rotates the reset key in the reverse direction to disengage the reset device with the body and removes the reset key from the main portion of the security apparatus which resets the security apparatus to the new combination.

Various embodiments of the invention provide a number of technical advantages. In some embodiments, the security apparatus provides a reset key that could help prevent accidental resetting of the combination. Such a reset key cannot be used to reset the combination without the user taking affirmative and intentional steps. For example, the user engages the reset key to disengage the tumblers, changes the combination on the dials, and removes the reset key to reset the combination. In addition, such a reset key may be separate or separable from the reset device. Such a reset key can be stored in a separate location to help prevent accidental resetting of the combination.

Certain embodiments of the invention may include none, some, or all of the above technical advantages. One or more other technical advantages may be readily apparent to one skilled in the art from the figures, descriptions, and claims included herein.

FIG. 1 shows a layout of a security system 10 comprising a portable electronic device 20 with an aperture 25 and a security apparatus 30 that is used to secure portable electronic device 20 to an immovable object 40 (e.g., a desk). Immovable object 40 refers to any suitable object that is not easily moved or disassembled such as a desk, a wall, floor, or any suitable large or heavy object. Aperture 25 can have dimensions of about 3×7 $mm^2$, and can be generally rectangular in shape. Security apparatus 30 can also be used with an interface member associated with the portable electronic device 20. Interface members are described in detail in U.S. patent application No. 60/940,318 filed on May 25, 2007, which is herein incorporated by reference in its entirety.

Security apparatus 30 comprises a main portion 50 that couples to portable electronic device 20, a connector 70 that secures main portion 50 of security apparatus 30 to immovable object 40, and a reset key 60 that allows a user to reset the combination of security apparatus 30. Although reset key 60 is shown coupled to main portion 50 by connector 70, in other embodiments, reset key 60 is uncoupled so that reset key 60 can be stored separately.

Any suitable method can be used to secure main portion 50 of security apparatus 30 to immovable object 40. In the illustrated example, connector 70 coupled to security apparatus 30 is securely wrapped around immovable object 40. Connector 70 refers to any suitable device that can be secured to the immovable object 40 so that portable electronic device 20 cannot be removed when it is attached to security apparatus 30. In one embodiment, connector 70 is a cable made of strong material such as stainless steel. In other embodiments, connector 70 may include a wireless device such as a wireless transmitter and/or receiver. The wireless device may be used in a proximity detection system or a motion detection system. For example, a motion detector could present in the wireless device so that when the motion detector moves, an associated alarm is triggered. The alarm may be in connector 70 or may be external to connector 70. In another embodiment, there may be a base device associated with the wireless device, and these components may be used in a proximity detection system. Wireless signals may be transmitted between connector 70 and the base device, and when these devices are separated by a predetermined distance, an associated alarm (e.g., an audible alarm) may be triggered. The alarm could be in the base device or in connector 70. The electronics associated with such wireless systems are known to those of ordinary skill in the art.

Portable electronic device 20 may comprise any suitable device that is to be secured. Examples of such devices 20 include portable computers such as laptop, desktop, and server computers, flat panel televisions and monitors, projectors, portable music players, printers, external hard-drives, memory sticks, cell phones, personal digital assistants, and the like. Portable electronic device 20 includes aperture 25 in its body or in another lock interface member associated with portable electronic device 20 for receiving and locking in place an attachment device 170 (shown in FIG. 2) of security apparatus 30. As used herein, aperture 25 may refer to a blind aperture or a through aperture and may be in the form of a hole or a recess.

Security apparatus 30 can be secured to portable electronic device 20 using any suitable method. For example, security apparatus 30 may include attachment device 170 (shown in FIG. 2) that can be secured within aperture 25 of portable electronic device 20 or other lock interface member associated with portable electronic device 20.

Figure 2:
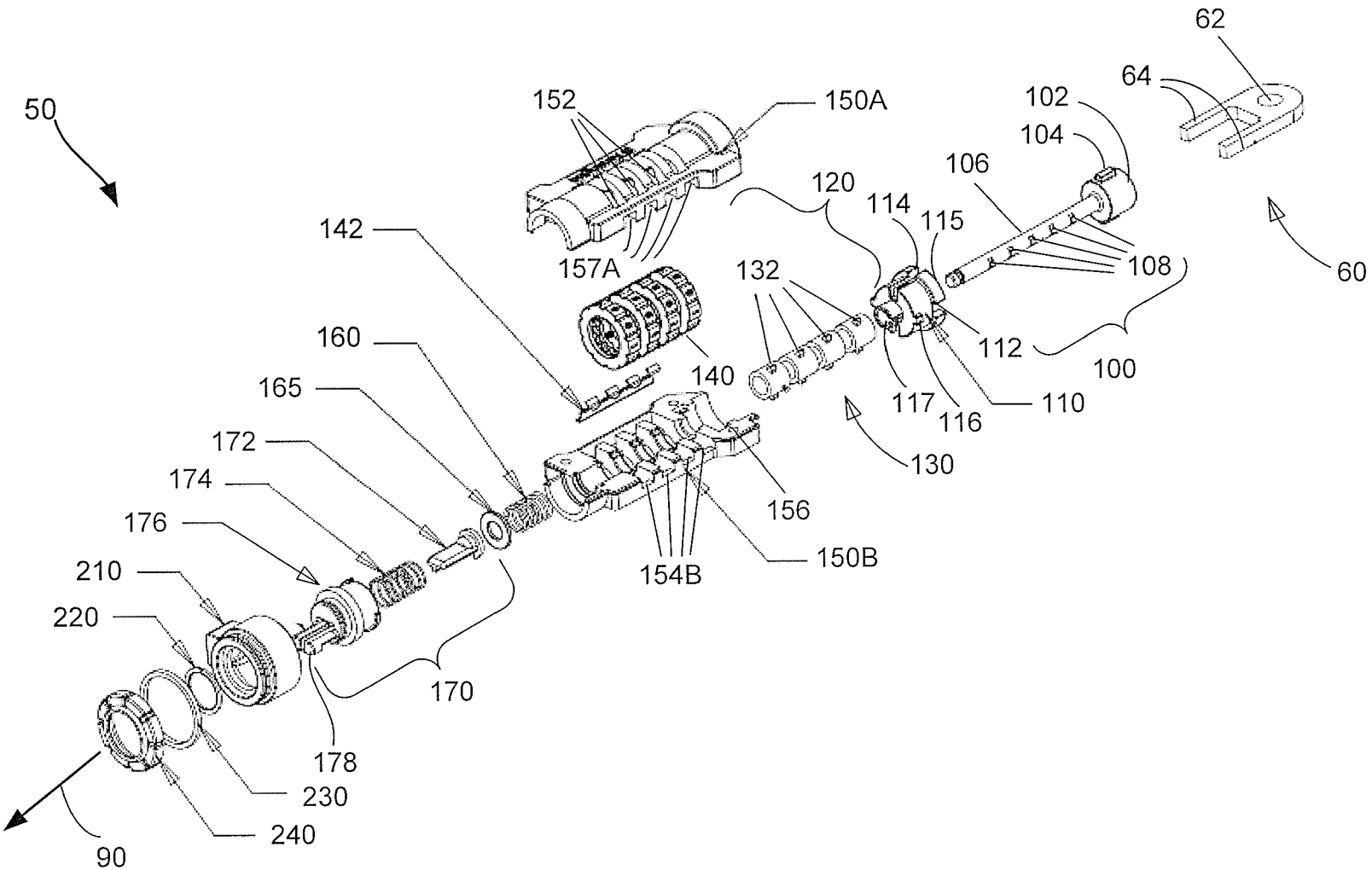
FIG. 2 shows an exploded front perspective view of the security apparatus, according to an embodiment of the invention.

FIG. 2 shows an exploded front perspective view of security apparatus 30 having main portion 50 and reset key 60 that is about to engage main portion 50 along longitudinal axis 90, according to an embodiment of the invention. Main portion 50 comprises a push button device 100, a reset device 110 coupled to push button device 100, a combination locking mechanism 120 having tumblers 130 and dials 140 coupled together. Reset device 110 can interface with tumblers 130 to disengage them from dials 140 which allows the current combination to be changed. Main portion 50 of security apparatus 30 also includes a body 150 that provides a housing for reset device 110, combination locking mechanism 120, push button device 100, and other components of security apparatus 30. Also included in main portion 50 are a tumbler biasing element 160 (e.g., a spring) coupled to and in front of tumblers 130, a washer 165 coupled to tumbler biasing element 160 to retain it, and attachment device 170 coupled to push button device 100 for securing security apparatus 30 to portable electronic device 20. Attachment device 170 comprises a slider, and a security member 176. The slider 172 moves relative to the securing member 176. In addition, main portion 50 includes a connector ring 210 coupled to connector 70 (shown in FIG. 1), a retaining clip 220, a color ring 230, and a bumper 240.

When resetting the combination, reset device 110 is pushed by reset key 60 to move tumblers 130 forward along longitudinal axis 90 to a reset position to disengage tumblers 130 from dials 140. When security apparatus 30 is unlocked but not in the reset configuration, attachment device 170 can be pushed forward by push button device 100 to secure attachment device 170 to portable electronic device 20.

Combination locking mechanism 120 refers to any suitable arrangement of tumblers 130, dials 140, and other locking devices that can be unlocked only by setting dials 140 to the correct combination. In some cases, dials 140 are turned in a certain sequence to the correct combination to unlock the mechanism. Any suitable type and number of dials 140 and tumblers 130 can be used. In the illustrated embodiment, combination locking mechanism 120 comprises a mechanical device that includes four wheel dials 140, four wheel tumblers 130 corresponding to each of the four dials 140, and a dial biasing element 142 coupled to dials 140. In another embodiment, combination locking mechanism 120 could include an electronic locking device with switches for changing the combination.

Dials 140 refer to suitable devices that are capable of allowing the user to select the combination. In the illustrated example, dials 140 are mechanical wheels with a plurality of symbols incrementally located along the circumference. Dials 140 include a plurality of ridges inside an inside surface that interface with tumblers 130. In another example, dials 140 may include electronic switches and/or a digital readout.

Dial biasing element 142 is any suitable device that provides resistance to the user moving dials 140. When the user moves each dial 140, dial biasing element 142 creates a resistance that makes it feel to the user as though that dial 140 is snapping into place at each symbol on dial 140. In the illustrated example, dial biasing element 142 is a leaf spring. The leaf spring includes four leaf spring arms that engage with each of four dials 140 to provide individual resistance to each dial 140. It helps to keep dials 140 at fixed radial positions selected by the user. Dial biasing element 142 is optional and not required in some embodiments.

Tumblers 130 refer to suitable devices that are capable of obstructing push button device 100 and reset device 110 from moving forward or backward (i.e. linearly) when security apparatus 30 is in a locked position. When security apparatus 30 is in an unlocked position, i.e., dials 140 turned to correct combination, tumblers 130 are aligned so that the obstruction is removed and the push button device 100 and reset device 110 can move forward. Tumblers 130 may include, for example, notches on an inside surface that align to allow forward passage of teeth 108 on push button device 100. Tumblers 130 also include teeth 132 on an outside surface that mate with the ridges inside dials 140 when the combination is not being reset. Unless the combination is being reset, tumblers 130 are coupled to dials 140 and rotate along with dials 140. Devices associated with tumblers 130 and dials 140 are known to those of ordinary skill in the art.

Tumbler biasing element 160 is any suitable device that provides a backward force when the tumblers 130 are moved forward along longitudinal axis 90 from their initial position to a reset position. In the illustrated embodiment, tumbler biasing element 160 is a coil spring that compresses when tumblers 130 are moved forward by a forward force. When the force is released, tumbler biasing element 160 pushes tumblers 130 substantially back to their initial position. Washer 165 is any suitable mechanism that retains tumbler biasing element 160 within body 150 when tumbler biasing element 160 is compressed.

Body 150 may be of any suitable shape and of any suitable material such as stainless steel. In the illustrated embodiment, body 150 includes an upper body 150A and a lower body 150B coupled to upper body 150A. Upper body 150A includes cutouts 152 that allow access for turning dials 140. Body 150 also has one or more openings 154 that are located where upper body 150A couples to lower body 150B. These openings 154 are for displaying the selected combination. In other embodiments, body 150 may have a marking that indicates the selected set of symbols on combination locking mechanism 120. For example, body 150 may have an arrow indicating the row of symbols that designate the selected set of symbols. Body 150 also includes a circumferential channel 156 (shown in FIG. 5) or receiving mechanism on an inside surface for interfacing with reset device 110. Body 150 may comprise any suitable hard material such as stainless steel.

Reset key 60 refers to any device that can be configured to place security apparatus 30 in the reset position so that the combination can be reset. In the illustrated example, reset key 60 is a mechanical instrument that has two tines 64 that can be inserted into reset device 110 and move reset device 110 forward along longitudinal axis 90 to the reset position. Reset key 60 also includes a cutout 62 for receiving connector 70 such as a cable.

Reset device 110 refers to any suitable device that is configured to disengage tumblers 130 from dials 140 when reset device 110 is placed in a reset position by reset key 60 so that a new combination can be selected. Such a suitable device is also configured to reengage tumblers 130 with dials 140 when reset key 60 is withdrawn to reset security apparatus 30 to the new combination. The illustrated embodiment of reset device 110 comprises two side slots 112, upper and lower slots 114, two tabs 116, a lip 115, and a front end 118 that interfaces with reset device 110. Side slots 112 are configured to receiving tines 64 of reset key 60. Upper and lower slots 114 are configured to receive rib details 104 on push button device 100.

Tabs 116 are configured to engage circumferential channel 156 of body 150 to keep reset device 110 in the reset position while the new combination is being selected. For example, reset key 60 may be rotated in either the clockwise or counterclockwise direction while reset device 110 is already pushed forward in the reset position. By rotating reset device 110, tabs 116 enter channel 156 in body 150 and reset device 110 is placed into a rotated position. Once tabs 116 are located within channel 156, reset key 60 is kept in the reset position until reset key 60 is rotated in the opposite direction and tab 116 is released from the channel 156. Although two tabs 116 are shown in the illustrated embodiment, tabs 116 may be of any suitable number.

Lip 115 is configured to restrict movement of push button device 100 when reset device 110 is in a rotated position. For example, lip 115 may obstruct the forward movement of push button device 100 by contacting rib details 104 when reset device 110 is in the rotated position.

Attachment device 170 may be any suitable combination of devices for securing portable electronic device 20 to security apparatus 30. In the illustrated example, attachment device 170 comprises a slider 172 a slider biasing element 174 coupled to slider 172, and a securing member 176 coupled to slider 172 for securing attachment device 170 to portable electronic device 20.

Slider 172 may be of any suitable dimensions and shape. In the illustrated embodiment, slider 172 comprises a shaft of a T-shape cross section coupled to a substantially flat cap.

Securing member 176 may have any suitable dimensions and shape. In some embodiments, securing member 176 may be configured to fit within and secure to aperture 25 in portable electronic device 20. In the illustrated embodiment, for example, the securing member 176 has two legs 178 facing outward. These legs 178 are inserted into aperture 25. In some embodiments, securing member 176 may also be configured to slidably interface with the shaft of slider 172. For example, securing member 176 has a longitudinal central groove for receiving shaft of slider 172. After the shaft of slider 172 moves along the longitudinal grove in securing member 176 into aperture 25, attachment device 170 can be secured within aperture 25.

Slider biasing element 174 is any suitable mechanism that applies a backward force to slider 172 when slider 172 is moved forward from its initial position. Slider biasing element 174 in the illustrated example is a coil spring that compresses when slider 172 is moved forward by push button device 100.

Push button device 100 refers to any suitable device that can be configured to push slider 172 forward to move the legs of securing member 176 into aperture 25 and lock securing member 176 into aperture 25 when push button device 100 is pressed. Push button device 100 is only free to move forward when security apparatus 30 is in the unlocked position. In the illustrated embodiment, push button device 100 comprises a button 102, rib details 104 located on opposite sides of an outer surface of button 102, a bar 106 coupled to button 102, and a series of teeth 108 located along bar 106. Button 102 is accessible outside of body 150 by a user. Rib details 104 are protrusions on an outside surface of button 102 that contact lip 115 when reset device 110 is in the rotated position so that push button device 100 cannot be moved forward. Bar 106 of push button device 100 may be of any suitable dimensions and shape. In the illustrated embodiment, bar 106 is a rod. Teeth 108 are any suitable shape and dimension to restrict forward movement of bar 106 within tumblers 130 when security apparatus 30 is locked. Teeth 108 may also be of suitable shape and dimension to move through the aligned grooves inside tumblers 130 when the security apparatus 30 is unlocked.

Main portion 50 of security apparatus 30 also includes a connector ring 210, retaining clip 220, color ring 230, and bumper 240 coupled in a series at the forward end of main portion 50 of security apparatus 30. Connector ring 210 has an opening for attaching one end of connector 70. Connector ring 210 has a substantially cylindrical shape. Connector ring 210 is coupled to body 150 so that translational movement along the axis 90 relative to body 150 is restricted, but the connector ring 210 is free to rotate about the axis 90 relative to body 150. Connector ring 210 has a groove at its forward end for receiving color ring 230 and bumper 240. Retaining clip 220 is a cylindrical ring located between connector ring 210 and color ring 230 for coupling connector ring 210 to body 150. Color Ring 230 is a cylindrical ring located within the groove at the front end of connector ring 210, adjacent to bumper 240. Bumper 240 is a cylindrical ring that is located at the front end of main portion 50 in the groove in connector ring 210. Bumper 240 is located at the front end of main portion 50 to prevent the front end from damaging surfaces of portable electronic device 20 or other surfaces which may come in contact with the front end. Bumper 240 may include a cushioning material such as rubber. Connector ring 210, retaining clip 220, color ring 230, and bumper 240 are all optional components of security apparatus 30 that can be omitted in some embodiments. In some embodiments, the function of each of these optional components can be performed by other components of security system 10.

Figure 3:
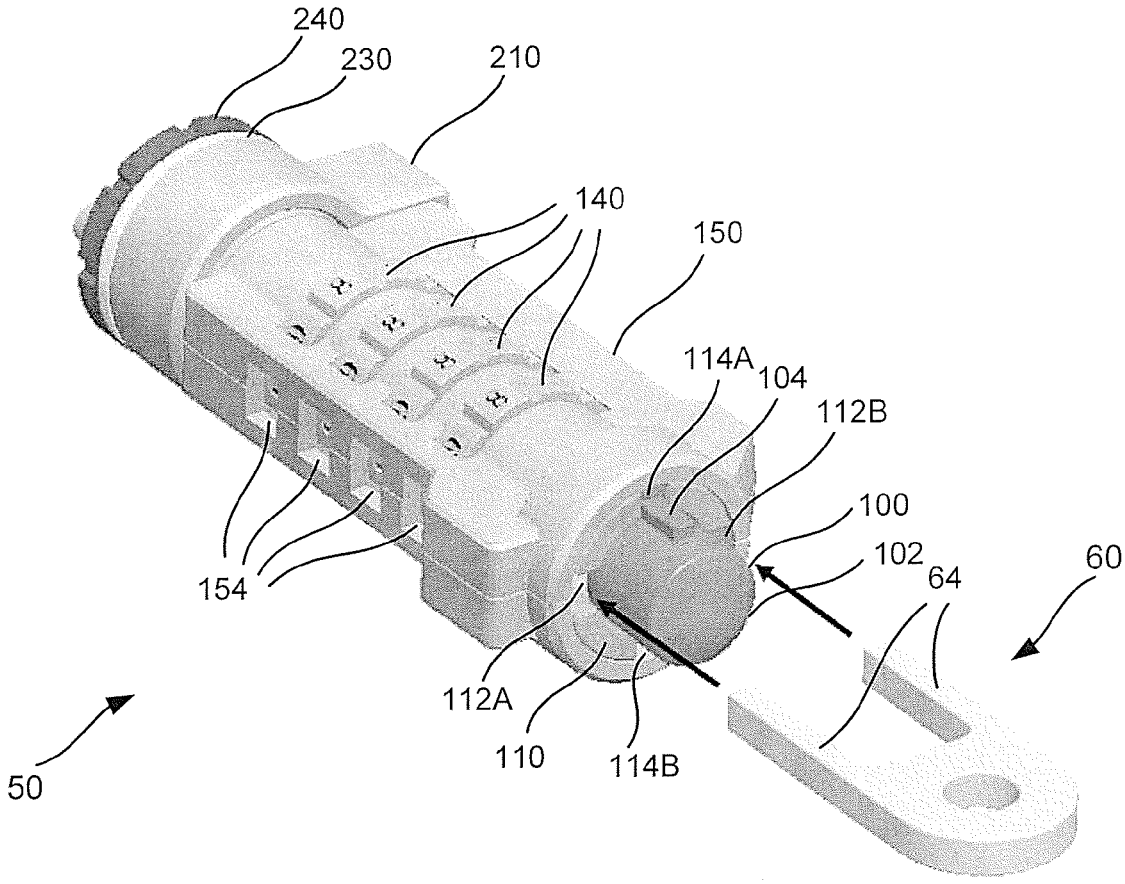
FIG. 3 shows a perspective view of the security apparatus where the tines of reset key are about to interface with the side slots of reset device to initiate resetting the combination of the security apparatus, according to an embodiment of the invention.

FIG. 3 shows a perspective view of security apparatus 30 where tines 64 of reset key 60 are about to interface with side slots 112 of reset device 110 to initiate resetting the combination of security apparatus 30 according to an embodiment of the invention. To reset the combination, the user first enters the correct combination on dials 140 as viewed through openings 154 in body 150 of security apparatus 30. When dials 140 are turned to the correct combination, tumblers 130 (not shown) align and reset device 110 is free to move forward. Since rib details 104 on the outside of button 102 are blocking upper and lower slots 114, tines 64 of reset key 60 are prevented from being accidentally inserted into upper and lower slots 114. The user may insert tines 64 into side slots 112 of reset device 110.

Figure 4:
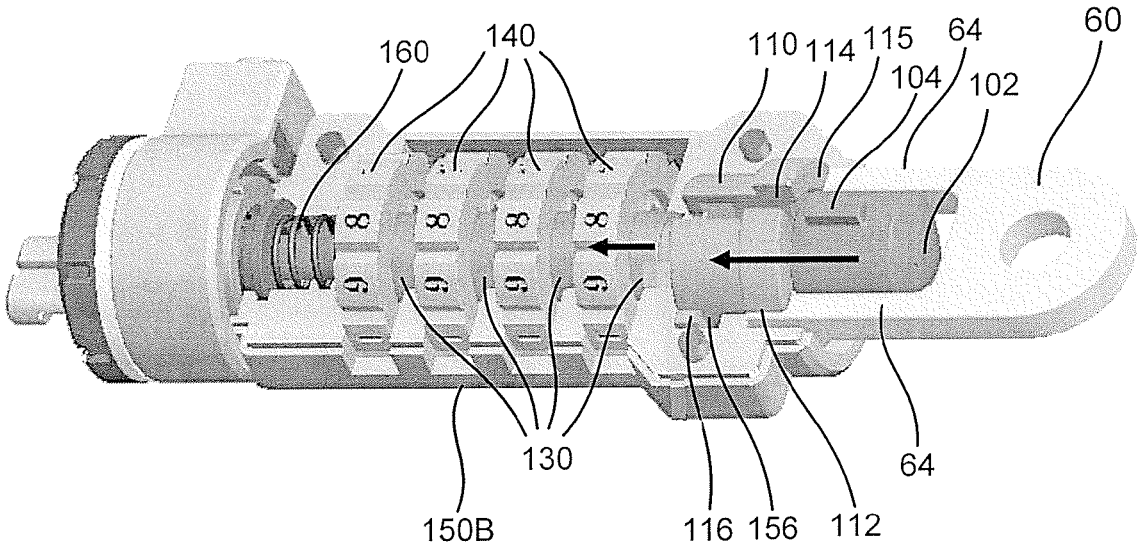
FIG. 4 shows a perspective view of the security apparatus without the upper body to show the reset key pushing forward the reset device which pushes forward the tumblers and compresses the tumbler biasing element, according to an embodiment of the invention.

FIG. 4 shows a perspective view of security apparatus 30 without upper body 150A to show reset key 60 pushing forward reset device 110 which pushes forward tumblers 130 and compresses tumbler biasing element 160, according to an embodiment of the invention. As shown in FIG. 4, the user has pushed reset key 60 into side slots 112 to move reset device 110 and tumblers 130 forward into a reset position where tumblers 130 are disengaged from dials 140. The forward movement is represented by arrows. As tumblers 130 are moved from their initial position, tumbler biasing element 160 is compressed.

Figure 5:
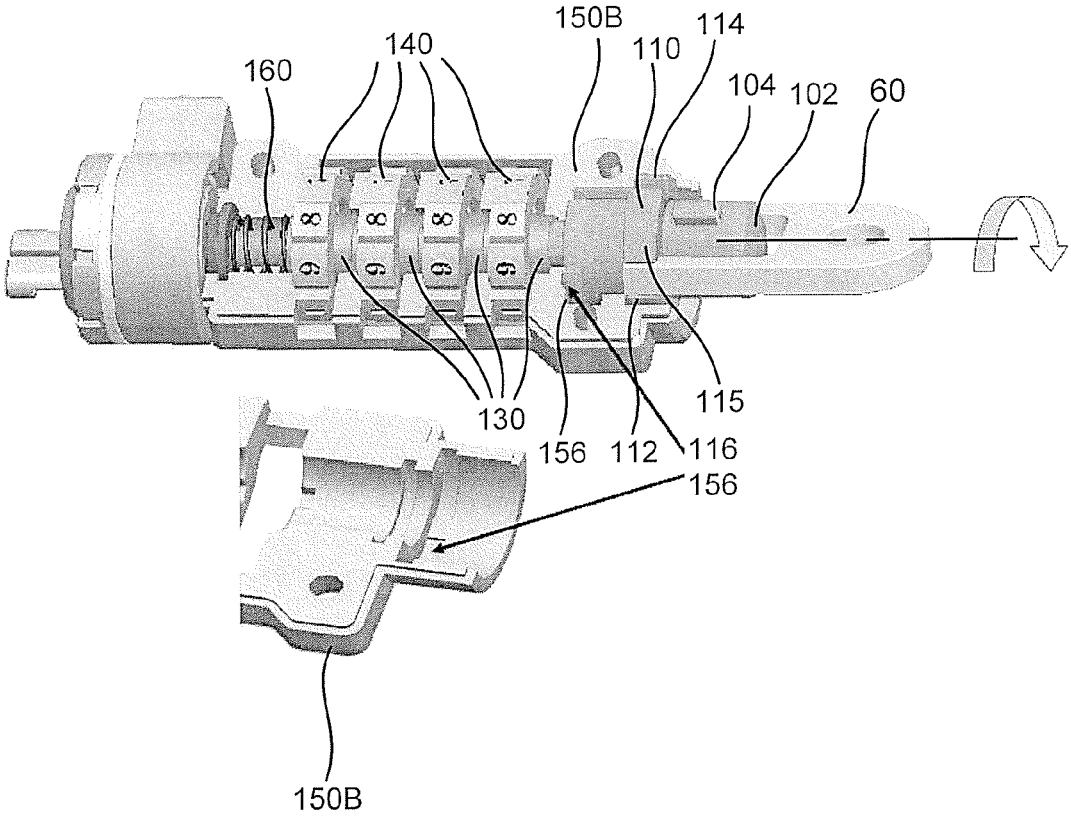
FIG. 5 shows a perspective view of the security apparatus without the upper body to show the tabs on the reset device engaging the channel in the lower body when the reset device is rotated by the reset key, according to an embodiment of the invention.

FIG. 5 shows a perspective view of security apparatus 30 without upper body 150A to show tabs 116 on reset device 110 engaging channel 156 in lower body 150B when reset device 110 is rotated by reset key 60, according to an embodiment of the invention. As shown in FIG. 5, the user can also rotate reset key 60 so that tabs 116 on reset device 110 are moved into channel 156 in body 150. While tabs 116 are located within body 150, reset device 110 is held in the reset position to facilitate changing the combination without requiring the user to continue to push reset key 60.

Figure 6:
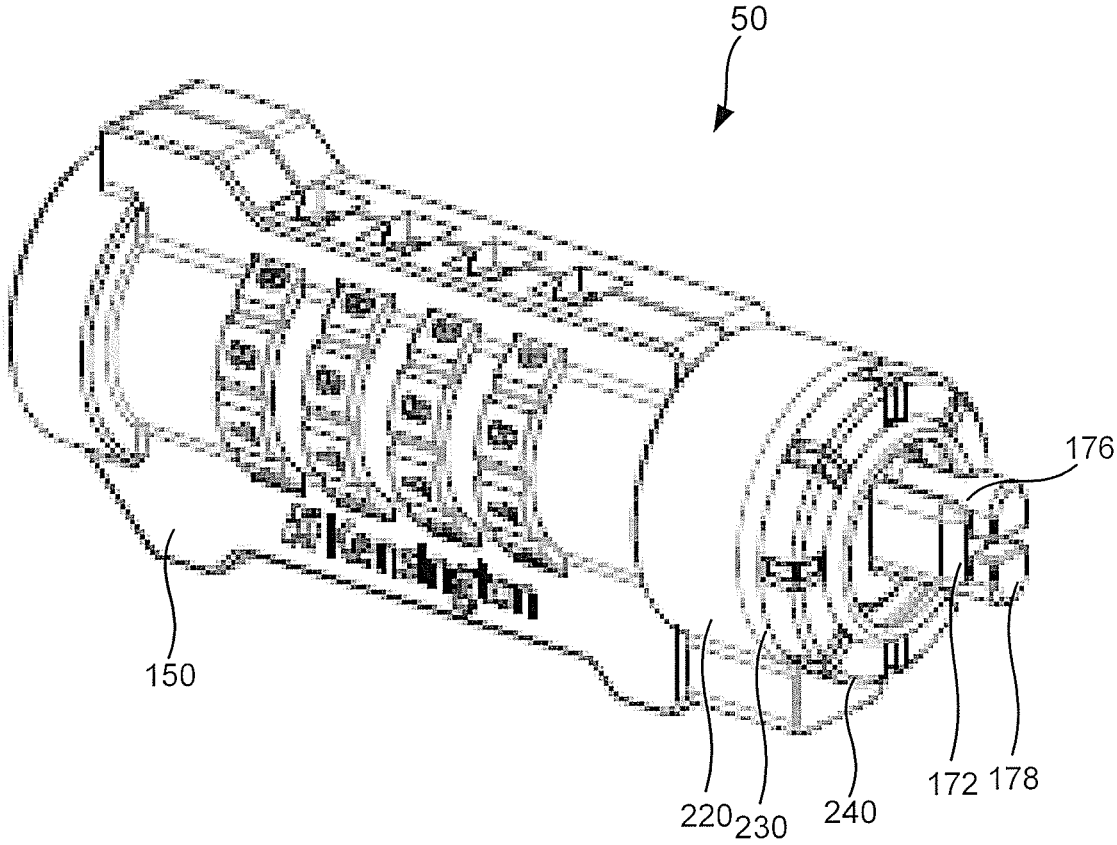
FIG. 6 shows a perspective view of the security apparatus showing the attachment device, according to an embodiment of the invention.

FIG. 6 shows a perspective view of the main portion 50 of security apparatus 30 showing slider 172 and securing member 176 of attachment device 170, according to an embodiment of the invention. As shown in FIG. 6, the shaft of slider 172 is slidably engaged with the longitudinal grove in securing member 176.

A more detailed description of the operation of an embodiment of security apparatus 30 is outlined below. To open the security apparatus 30, the user first enters the correct combination on dials 140 as viewed through openings 154 in body 150 of security apparatus 30. When dials 140 are turned to the correct combination, notches inside tumblers 130 align so that teeth 108 on push button device 100 are no longer obstructed from movement. Bar 106 can move freely through the center of tumblers 130.

To attach the open security apparatus 30 to portable electronic device 20, the user inserts legs 178 of securing member 176 into aperture 25. User pushes button 102 to push bar 106 forward from its initial position. The end of bar 106 pushes slider 172 forward which compresses slider biasing element 174. As shown in FIG. 6, the shaft of slider 172 slidably engages with the grove of securing member 176. As the slider is moved forward, shaft of slider 172 moves forward into aperture 25 while remaining coupled to securing member 176. User turn dials 140 from the correct combination to lock slider 172 in place and secure attachment device 170 to portable electronic device 20.

To detach security apparatus 30 from portable electronic device 20, the user enters the correct combination so slider 172 is released. Slider biasing element 174 decompresses and pushes slider 172 backward out of aperture 25. The user removes legs 178 of securing member 176 from aperture 25 to detach the security apparatus 30 from portable electronic device 20.

To reset the combination, the user enters the correct combination on dials 140 as viewed through openings 154 in body 150 of security apparatus 30. When dials 140 are turned to the correct combination, tumblers 130 align and reset device 110 is free to move forward.

To reset the combination, the user inserts reset key 60 into side slots 112 in reset device 110. FIG. 3 shows an embodiment of security apparatus 30 as reset key 60 is about to be inserted into reset device 110. In this example, user inserts tines 64 into side slots 112 of reset device 110 along the sides of button 102 of push button device 100. Tines 64 of reset key 60 are pushed into side slots 112 until tines 64 contact reset device 110 at the end of side slots 112.

The user continues to push in reset key 60 to push reset device 110 to move tumblers 130 forward a predefined distance relative to dials 140 to a reset position from their initial position. This predefined distance is any suitable distance for disengaging teeth 132 of tumblers 130 from mating ridges inside dials 140. In some cases, the predefined distance is about 1.2 mm. FIG. 4 shows an embodiment of security apparatus 30 where reset device 110 is in the reset position. As shown, tumbler biasing element 160 is compressed by tumblers 130 when reset device 110 is in the reset position. Once tumblers 130 are disengaged from dials 140 in the reset position, dials 140 are free to spin separately from tumblers 130 so that the user can select a new combination for security apparatus 30.

While keeping reset key 60 in the reset position, user rotates reset key 60 to rotate reset device 110 in a predefined direction and to a predefined rotation relative to body 150 to a rotated position. The predefined direction and rotation are any suitable rotation and direction that cause tabs 116 on reset device 110 to be guided into channel 156 in body 150. For example, reset key 60 can be rotated clockwise by 55 degrees. FIG. 5 shows an embodiment of security apparatus 30 where reset device 110 is in the rotated position. Once in the rotated position, reset device 110 is held in the reset position. The user releases forward pressure on reset key 60 and change the combination on dials 140.

The user reversibly rotates the reset key 60 so that tabs 116 move out of channel 156 and removes reset key 60 from side slots 112 in reset device 110. Tumbler biasing element 160 decompresses pushing tumblers 130 and reset device 110 backward substantially to their initial positions so that tumblers 130 reengage with dials 140 and reset the combination of security apparatus 30.

The above description is illustrative and is not restrictive. Many variations of the invention will become apparent to those skilled in the art upon review of the disclosure. The scope of the invention should, therefore, be determined not with reference to the above description, but instead should be determined with reference to the pending claims along with their full scope or equivalents.

One or more features from any embodiment may be combined with one or more features of any other embodiment without departing from the scope of the invention.

A recitation of "a", "an" or "the" is intended to mean "one or more" unless specifically indicated to the contrary.

All patents, patent applications, publications, and descriptions mentioned above are herein incorporated by reference in their entirety for all purposes. None is admitted to be prior art.

What is claimed is:

1. A security apparatus for use with a portable electronic device having a first aperture, comprising:

a combination locking mechanism having a plurality of tumblers and a plurality of dials corresponding to the plurality of tumblers;

a first biasing element coupled to the plurality of tumblers, wherein the first biasing element is compressed when the plurality of tumblers is in a reset position;

a bar that is linearly moveable within the plurality of dials when the combination locking mechanism is in an unlocked position;

a second biasing element wherein the second biasing element is compressed when the bar is in a forward position;

a body coupled to the plurality of dials;

a reset device coupled to the plurality of tumblers; and a reset key configured to interact with the reset device to allow a user to change a combination associated with the combination locking mechanism.

2. The security apparatus of claim 1, wherein the reset key interacts with the reset device to disengage the plurality of tumblers from the plurality of dials to allow the user to change the combination; and wherein the reset key interacts with the reset device to reengage the plurality of tumblers with the plurality of dials to reset the combination locking mechanism to the changed combination.

3. The security apparatus of claim 2, wherein the reset key is further configured to keep the reset device in a reset position while the user changes the combination.

4. The security apparatus of claim 1, further comprising an attachment device coupled to the body, the attachment device configured to interact with the first aperture of the portable electronic device to prevent the attachment device from being removed from the first aperture when the combination locking mechanism is in a locked position.

5. The security apparatus of claim 1, wherein the reset key has one or more tines; and wherein the reset device has one or more slots for accepting the one or more tines of the reset key.

6. A method of using the security apparatus of claim 1 with a portable electronic device having a first aperture, the method comprising:

interfacing the reset key with the reset device; and changing the combination associated with the combination locking mechanism.

7. The method of claim 6, wherein changing the combination includes:

pushing the reset device to a reset position with the reset key to disengage the plurality of tumblers from the plurality of dials;

changing the plurality of dials to a new combination; and setting the new combination by returning the reset device to an initial position to engage the plurality of tumblers with the plurality of dials by withdrawing the reset key.

8. The method of claim 6, further comprising engaging an attachment device with the first aperture of the portable electronic device to prevent the attachment device from being removed from the first aperture when the combination locking mechanism is in a locked position.

9. A method of using a security apparatus with a portable electronic device having a first aperture, the security apparatus comprising a combination locking mechanism having a plurality of tumblers and a plurality of dials corresponding to the plurality of tumblers, a body coupled to the plurality of dials, a reset device coupled to the plurality of tumblers, and a reset key configured to interact with the reset device to allow a user to change a combination associated with the combination locking mechanism, the method comprising:

interfacing the reset key with the reset device;

changing the combination associated with the combination locking mechanism, wherein changing the combination includes pushing the reset device to a reset position with the reset key to disengage the plurality of tumblers from the plurality of dials, changing the plurality of dials to a new combination, and setting the new combination by returning the reset device to an initial position to engage the plurality of tumblers with the plurality of dials by withdrawing the reset key; and rotating the reset device to a rotational position with the reset key to engage the reset device with a body coupled to the combination locking mechanism.

10. The method of claim 7, further comprising compressing a first biasing element coupled to the plurality of tumblers when the reset device is in the reset position.

11. A security system, comprising:

an immovable object;

a portable electronic device having a first aperture; and a security apparatus coupled to the immovable object, the security apparatus having:

a combination locking mechanism having a plurality of tumblers and a plurality of dials corresponding to the plurality of tumblers;

a first biasing element coupled to the plurality of tumblers, wherein the first biasing element is compressed when the plurality of tumblers is in a reset position;

a bar that is linearly moveable within the plurality of dials when the combination locking mechanism is in an unlocked position;

a second biasing element wherein the second biasing element is compressed when the bar is in a forward position;

a body coupled to the plurality of dials;

a reset device coupled to the plurality of tumblers; and a reset key configured to interact with the reset device to allow a user to change a combination associated with the combination locking mechanism.

12. The security system of claim 11, wherein the reset key interacts with the reset device to disengage the plurality of tumblers from the plurality of dials to allow a user to change the combination; and wherein the reset key interacts with the reset device to reengage the plurality of tumblers with the plurality of dials to reset the combination locking mechanism to the changed combination.

13. The security system of claim 12, wherein the reset key is further configured to keep the reset device in a reset position while the user changes the combination.

14. The security system of claim 11, wherein the security apparatus further comprises an attachment device coupled to the body, the attachment device configured to interact with the first aperture of the portable electronic device to prevent the attachment device from being removed from the first aperture when the combination locking mechanism is in a locked position.

15. The security system of claim 11, wherein the reset key has one or more tines; and wherein the reset device has one or more slots for accepting the one or more tines of the reset key.

* * * * *